US007950437B2

(12) United States Patent
Lin

(10) Patent No.: US 7,950,437 B2
(45) Date of Patent: May 31, 2011

(54) WINDOW COVERING

(75) Inventor: Tzong Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 92 days.

(21) Appl. No.: 12/157,010

(22) Filed: Jun. 6, 2008

(65) Prior Publication Data

US 2009/0301670 A1 Dec. 10, 2009

(51) Int. Cl.
*E06B 9/30* (2006.01)

(52) U.S. Cl. ..... 160/168.1 R

(58) Field of Classification Search ..... 160/170, 160/168.1 R, 168.1 P, 173 R, 171; 24/265 H, 24/370; 403/397, 209, 210
See application file for complete search history.

(56) References Cited

U.S. PATENT DOCUMENTS

| | | | | |
|---|---|---|---|---|
| 13,251 | A | 7/1855 | Bixler | |
| 2,687,769 | A | 8/1954 | Gershuny | |
| 3,795,266 | A * | 3/1974 | Debs | 160/168.1 R |
| 5,193,601 | A | 3/1993 | Corey et al. | |
| 5,482,750 | A | 1/1996 | Colson et al. | |
| 6,079,471 | A | 6/2000 | Kuhar | |
| 6,234,236 | B1 | 5/2001 | Kuhar | |
| 6,325,131 | B1 | 12/2001 | Dekker et al. | |
| 6,644,372 | B2 | 11/2003 | Judkins | |
| 6,837,294 | B2 | 1/2005 | Cheng et al. | |
| 6,991,020 | B1 | 1/2006 | Cheng et al. | |
| 7,159,634 | B1 | 1/2007 | Judkins | |
| 2004/0129390 | A1 | 7/2004 | Toti | |
| 2004/0154758 | A1 * | 8/2004 | Cheng et al. | 160/170 |
| 2007/0163727 | A1 | 7/2007 | Cheng et al. | |

* cited by examiner

*Primary Examiner* — Katherine Mitchell
*Assistant Examiner* — Jeremy C Ramsey
(74) *Attorney, Agent, or Firm* — Buchanan Ingersoll & Rooney PC

(57) ABSTRACT

A window covering is disclosed that includes a first rail, window covering material adjacent the first rail, at least one lift cord extending through the window covering material to the headrail, a plurality of pulleys positioned adjacent the first rail, at least one spring motor adjacent the first rail, at least one spring motor cord extending from the one or more spring motors and a rigid connector attached to one or more spring motor cords and one or more lift cords. The connector and one or more spring motor cords are configured to pass along at least one of the pulleys during movement along a cord path defined by one or more of the pulleys. The connector should have a length that is not greater than ⅙ of the circumference of at least one of the pulleys the connector passes over during extension of the window covering material.

20 Claims, 8 Drawing Sheets

WINDOW COVERING

FIELD OF INVENTION

The invention relates to window coverings.

BACKGROUND OF THE INVENTION

Window coverings, such as venetian blinds, roman shades, cellular shades or pleated shades, often have a headrail, a bottom rail and window covering material between the headrail and the bottom rail. U.S. Pat. Nos. 13,251, 2,687,769, 6,079,471, 6,234,236, 6,644,372, and 7,159,634 and U.S. Patent Application Publication Nos. 2007/0163727, 2004/0129390 disclose examples of such window coverings. Window coverings are typically mounted adjacent a window and are used to cover the window and provide a desired aesthetic effect to the interior and exterior of a home, office or other building. The window covering material is often moveable from a retracted position adjacent the headrail to various extended positions that lower the bottom rail and permit the window covering material to cover a window.

Various different lift systems are used to permit a user to adjust the position of the window covering material. For example, U.S. Pat. No. 6,991,020 to Cheng et al. discloses a window covering that utilizes a cord lock and an operator cord that extends through the cord lock and is attached to lift cords. The operator cord extends out of the cord lock and may be manipulated by a user to adjust the position of the window covering.

U.S. Pat. No. 6,837,294 to Cheng et al. provides a similar disclosure to U.S. Pat. No. 6,991,020 and also discloses a cordless shade that utilizes a spring motor that includes two spring motor cord spools. A spring motor cord is entrained about these spools and is attached to lift cords. A user adjusts the position of the window covering material by providing a downward force to the bottom rail of the window covering to extend the window covering material or an upward force to the bottom rail to permit the spring motor to retract the lift cords and the window covering material.

Cheng et al. teach that the attachment of the spring motor cord or operator cord to the lift cords should not pass over any pulley to avoid entanglement of the cords that may cause "hang up" problems that may make moving the window covering material problematic for a user. (See e.g. U.S. Pat. No. 6,991,020, Col. 3, lines 46-55). Such binding may result in a user having to exert a substantial force to extend the window covering material. Sometimes, such forces can cause the attachment between the cords to break or cause other damage to the window covering. These "hang up" problems can also result in a non-level window covering due to the entanglement of the cords, which often produces an undesirable aesthetic effect.

Further, the need for the attachment of the cords in the lift systems disclosed by Cheng et al. to not pass over a pulley limits the extent to which the window covering material may be extended below the headrail to, at most, the length of the headrail. If the full length of the headrail is filled with cords, spools and spring motor to provide a maximum length of the window covering, the window covering cannot be used in stock window covering programs or cut down programs. In these programs, window coverings are made in a limited number of stock sizes, which may then be cut down by a retailer to fit a specific window opening dimension provided by a customer. Cut down programs typically offer blinds or shades for lower prices relative to custom made window coverings because a retailer is able to take advantage of economies of scale involved in the production of the limited number of available stock sized window coverings. Window coverings that can only provide a length of extended window covering material that is relatively equivalent to the length of a headrail typically cannot provide the window covering material length necessary for use in one or more stock blinds of window covering cut down programs.

U.S. Patent Application No. 2004/0129390 to Toti discloses a window covering that includes lift cords connected to a spring motor by various interlocking gears or other transmission systems. Such interlocking gears or transmission systems can be expensive to manufacture. Moreover, such lift systems often require precise fabrication due to the need for the various interlocking components to reliably interact with each other. Often, only very large window coverings, which are typically much heavier and costlier than other window coverings, may economically include such systems and still be produced efficiently enough to meet the price expectations of a customer.

A window covering is needed that includes a connection between one or more lift cords and one or more operator cords or spring motor cords that reduces, if not completely eliminates, cord entanglement problems or "hang up" problems so that the connection of the cords may reliably pass over one or more pulleys in a window covering lift system. Preferably, such a connection does not require interlocking gears or other expensive or complicated mechanisms to provide a cost effective solution to such cord entanglement or "hang up" problems.

SUMMARY OF THE INVENTION

I provide a window covering that includes a first rail, window covering material adjacent the first rail, one or more lift cords, multiple pulleys positioned adjacent the first rail, at least one spring motor adjacent the first rail, one or more spring motor cords extending from the one or more spring motors and a rigid connector attached to the one or more spring motor cords and the one or more lift cords. The window covering material is moveable from a retracted position to an extended position. The one or more spring motor cords are configured to extend away from the one or more spring motors and travel along a path defined by at least one of the pulleys when the window covering material is raised or lowered. The rigid connector is attached to the one or more spring motor cords and the one or more lift cords. The connector is sized and configured to permit the one or more spring motor cords, connector and a portion of the one or more lift cords to pass along at least one of the pulleys during movement along the path. The connector has a length that is not greater than 1/6, and preferably is not greater than 1/12, of the circumference of at least one of the pulleys the connector passes over when the window covering material is extended from the retracted position to the extended position.

Other embodiments of my window covering may replace the spring motor and spring motor cord with a cord lock and one or more operator cords. The one or more operator cords include a first portion that extends through the cord lock and is attached to the connector. A user may raise or lower the blind by manipulating the operator cord. The first portion of the one or more operator cords move along the same path as the one or more spring motor cords would travel when the window covering is raised or lowered.

Embodiments of my window covering may include connectors of various shapes. For example, the connector may have a generally C-shaped body, a generally S-shaped body, a ring that has a generally oval shaped body or a ring that has a generally circular body. Preferably, the connector is composed of metal, such as steel, copper or aluminum, or a rigid plastic such as high density polyethylene (HDPE) or polypropylene.

Some embodiments of my window covering may include typical shades or blinds such that the first rail is a headrail. Other embodiments of my window covering may include top down bottom up shades where the first rail is an intermediate rail that is moveable relative to a headrail. Yet other embodiments may include a second rail connected to at least one of the first rail and the window covering material such that the first rail is located below the second rail and is moveable relative to the second rail.

Preferably, the one or more lift cords are looped about the connector to attach the one or more lift cords to the connector. The one or more spring motor cords or operator cords may also be looped about the connector to attach the one or more spring motor cords or operator cords to the connector.

Various different pulley arrangements may be used in embodiments of my window covering. One embodiment may include pulleys that include first, second, and third pulleys aligned with each other adjacent the first end of the first rail and fourth, fifth and sixth pulleys aligned with each other adjacent the second end of the first rail, which is opposite the first end of the first rail. Preferably, the first, second and third pulleys are connected to a first pulley mount and the fourth, fifth and sixth pulleys are connected to a second pulley mount.

The path of the connector and one or more spring motor cords or operator cords can be defined by movement of the connector and one or more spring motors or operator cords from adjacent the one or more spring motors to the first pulley, from the first pulley to the fourth pulley, form the fourth pulley, to the second pulley and from the second pulley to the fifth or sixth pulley when the window covering material is extended from the retracted position to the extended position. Preferably, movement of the connector and one or more spring motor cords or operator cords is reversed at least once when traveling along the path when the window covering material is moved from the retracted position to the extended position. For example, the connector and one or more spring motor cords may move along the path such that movement of the one or more spring motor cords and connector is reversed from movement toward the first end of the first rail to movement toward the second opposite end of the first rail at least once while moving along the path when the window covering material is retracted from the extended position to the retracted position or extended from the retracted portion to the extended position.

It should be appreciated that the path may include more than one reversal of movement. For instance, the movement of the one or more spring motor cords or operator cords and connector may also be reversed from movement toward the second end of the first rail to movement toward the first end of the first rail at least once while moving along the path when the window covering material is retracted from the extended position to the retracted position or extended from the retracted portion to the extended position. It should be understood that such reversals of movement can permit the window covering material to be extended a distance that is much longer than the length of the headrail so that short headrails may be used for window coverings that must cover tall and narrow windows.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the invention are shown in the accompanying drawings and certain present preferred methods of practicing the same are also illustrated therein, in which.

DESCRIPTION OF PRESENT PREFERRED EMBODIMENTS

Figure 1:
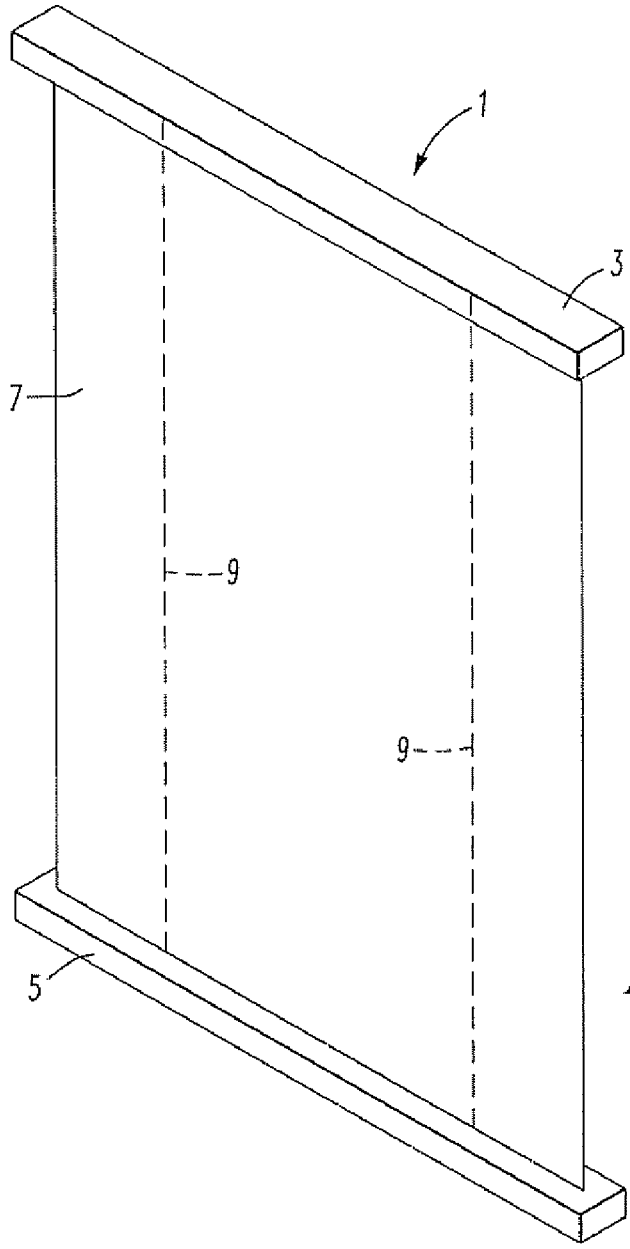
FIG. 1 is a perspective view of a first present preferred embodiment of my window covering illustrating the window covering material in an extended position.

Referring to FIG. 1, a cordless window covering 1 is illustrated in an extended position. The window covering 1 has a headrail 3, a bottom rail 5 and window covering material 7 positioned between the headrail 3 and bottom rail 5. The window covering material 7 is connected to the headrail by at least one lift cord 9 such that that window covering material 7 can be moved from an extended position to a retracted position. When the window covering material 7 is in a retracted position, the window covering material is compressed adjacent the headrail 3 and the bottom rail is positioned close to the headrail 3. When the window covering material is in an extended position, the window covering material 7 is positioned so that the bottom rail 5 is located at a position that is farther from the headrail 3 than when the window covering is in the retracted position.

Figure 2:
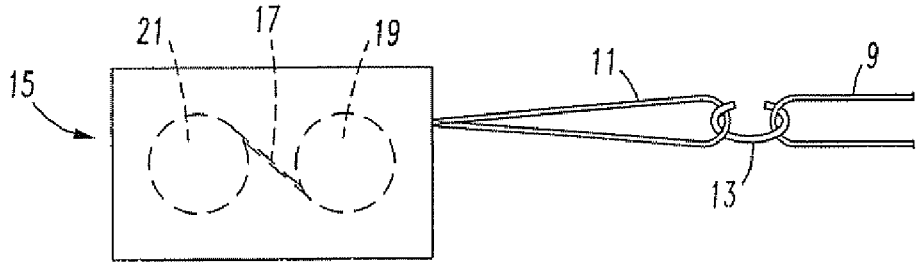
FIG. 2 is a fragmentary view of a first present preferred connector attached to a portion of a lift cord and a spring motor cord.

The window covering material 7 is suspended by a spring motor 15 that is connected to the lift cord 9 by a spring motor cord 11 and a rigid connector 13 that attaches the spring motor cord 11 to the lift cord 9. As may best be appreciated from FIGS. 2-5, the spring motor 15 is housed within a cradle and includes a first spool 19 and a second spool 21, which are both illustrated in dotted line in FIG. 2. A spring 17, which is also illustrated in dotted line in FIG. 2, engages both spools 19 and 21 and is configured to provide enough force to the spring motor cord 11, connector 13 and lift cord 9 to maintain the position of the window covering material 7 at any selected position. The spring motor cord 11 is wound about or unwound from a spool (not shown) that is attached to the first spool 19. The spring motor cord 11 is attached to this spool (not shown) such that it extends from the spring motor 15 when the first spool 19 rotates in a first direction and is retracted toward the spring motor and wound about the spool when the first spool rotates in a second direction that is opposite the first direction. It should be appreciated that the spring motor 15 may alternatively be any other type of spring motor that is known in the art or include interconnected spring motors.

As one skilled in the art will appreciate, a user may extend the window covering material 7 by applying a downward force to the bottom rail 5 or window covering material 7 that is greater than the suspension force provided by the spring motor 15. The spring motor 15 is also configured to retract the spring motor cord 11, connector 13 and lift cord 9 when a user applies an upward force to the bottom rail 5.

The connector 13 of the first present preferred embodiment has a generally C-shaped body. One end of the generally C-shaped body is attached to a portion of the spring motor cord 11 that is looped about that end of the connector. The opposite end of the connector 13 is attached to the lift cord 9 such that a middle portion of the lift cord 9 is attached to that end of the connector 13. The two opposite ends of the lift cord 9 pass over the pulleys and extend through respective holes 36 and 38 adjacent opposite ends of the headrail 3.

Figure 3:
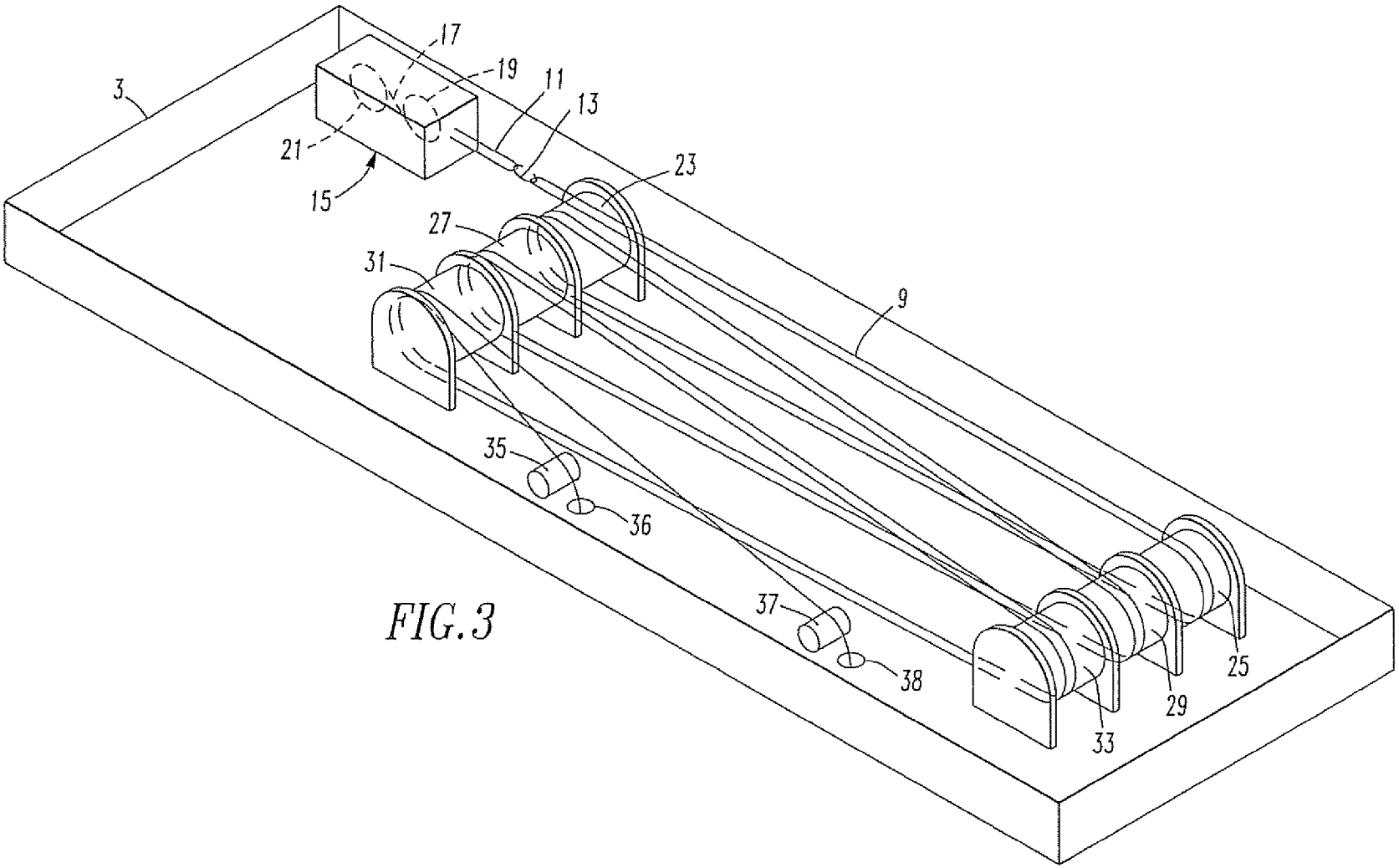
FIG. 3 is a perspective view of the first present preferred embodiment with a portion of the headrail cut way to illustrate the pulleys, spring motor, first present preferred connector and cord path wherein a portion of the cord path is shown in chain line. The position of the connector corresponds with the window covering material being in a fully retracted position.
Figure 4:
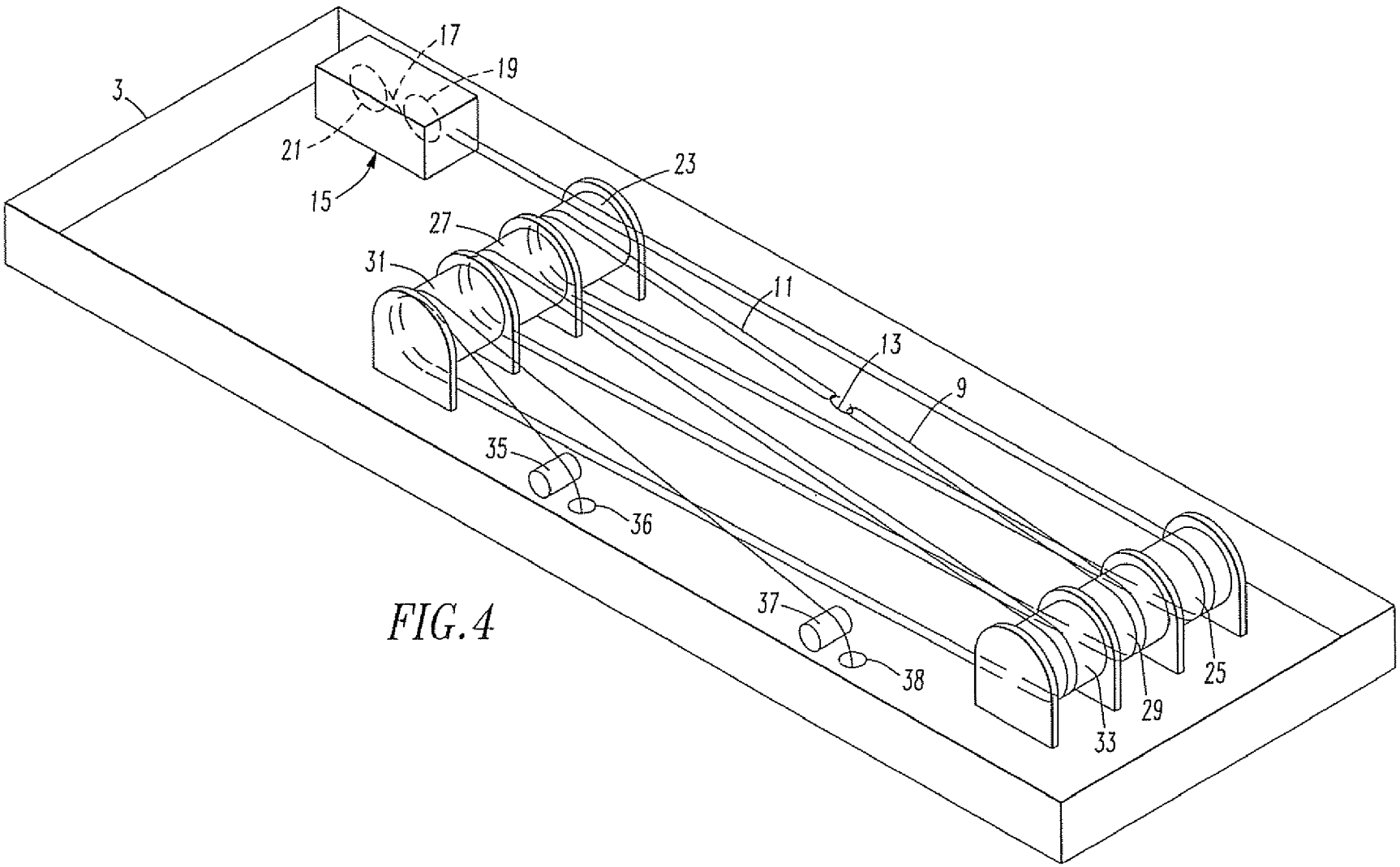
FIG. 4 is a perspective view similar to FIG. 3 illustrating the connector and spring motor cord of the first present preferred embodiment in a position that corresponds with the window covering material being in an extended position.
Figure 5:
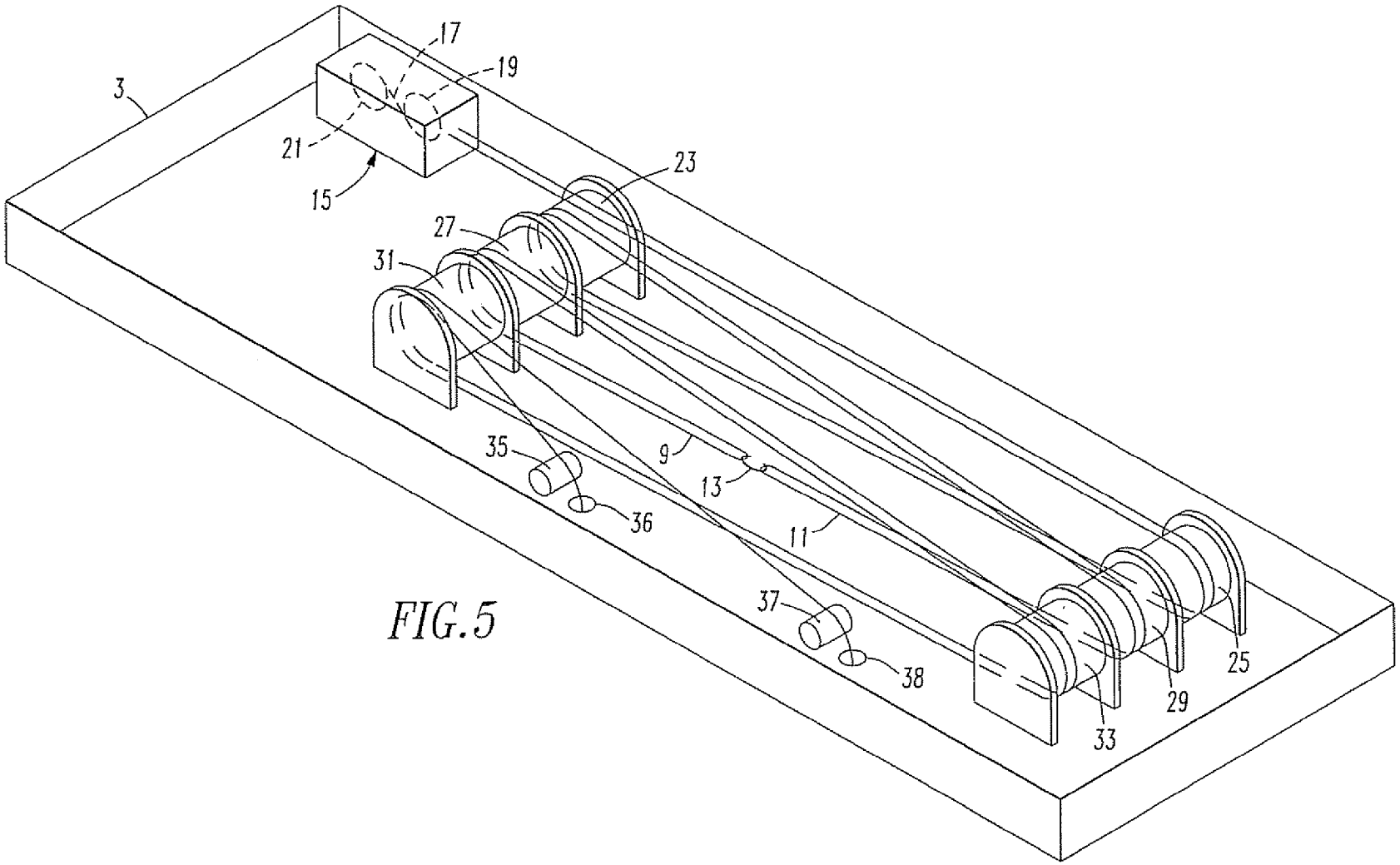
FIG. 5 is a perspective view similar to FIGS. 3 and 4 illustrating the first present connector and spring motor cord of the first present preferred embodiment in a position that corresponds with the window covering material being in a fully extended position.

As may be seen in FIGS. 3-5, the spring motor cord 11, connector 13 and lift cord 9 extend from the spring motor 15 over multiple pulleys located within, on or otherwise adjacent the headrail. The pulleys include a first pulley 23, a second pulley 25, a third pulley 27, a fourth pulley 29, a fifth pulley 31, a sixth pulley 33, a seventh pulley 35 and an eighth pulley 37. The first, third and fifth pulleys 23, 27 and 31 are aligned with each other adjacent a first end of the headrail 3 and the second, fourth and sixth pulleys 25, 29, 33 are aligned with each other adjacent the opposite end of the headrail 3. Preferably, the first, third and fifth pulleys 23, 27 and 31 are all mounted to one pulley mount to form a three wheel pulley, or triple spool pulley and the second, fourth and sixth pulleys 25, 29, 33 are also mounted to one pulley mount to form a three wheel pulley or a triple spool pulley.

It should be understood that the spring motor cord 15 and lift cord 9 are illustrated in FIGS. 3-5 such that the lower portions of the cords are illustrated in chain line to more clearly illustrate the cord path. Portions of each cord that extends from adjacent the top of one pulley to adjacent the top of another pulley are shown in a regular line and portions of each cord that extend from adjacent the bottom of one pulley to adjacent the bottom of another pulley are shown in chain line.

When the window covering material 7 is in a fully retracted position, the spring motor cord 11, connector 13 and lift cord 9 will be in an initial position, which is illustrated in FIG. 3. In this initial position, the spring motor cord 11 and connector 13 are located relatively near the spring motor and the lift cord 9 preferably extends over all the pulleys in the headrail.

When a user extends the window covering material to an extended position, the spring motor cord 11 extends away from the spring motor 15 along a path defined by one or more of the pulleys 23, 25, 27, 29, 31, or 33. The connector 13 and lift cord 9 are also moved along this path. As may be appreciated from FIG. 4, an intermediate extended position of the window covering material can correspond with an extension of the spring motor cord 11 away from the spring motor 15 such that the spring motor cord 11 and connector 13 pass over and along the second pulley 25 and then move back toward the first pulley 23 to a position between the first pulley 23 and the second pulley 25. At this position, the window covering material may be only partially extended so that the window covering may only block or cover a portion of a window it is positioned adjacent to.

When a user extends the window covering material 7 from the partially extended position shown in FIG. 4 to a fully extended position, the window covering material may be extended to fully cover a window it is positioned adjacent to. In this position, which is shown in FIG. 5, the spring motor cord 11, connector 13 and lift cord 9 move along the path defined by the pulleys so that the spring motor cord 11 and connector 13 pass along the first pulley 23, move toward the fourth pulley 29, pass along the fourth pulley 29 and move toward the third pulley 27 to a position located between the third and fourth pulleys 27 and 29.

I have found that the length of the connector 13 is important to ensure that the extending and retracting of the window covering material does not cause various undesirable problems. A connector that is too long will often bind up when passing along a pulley so that a user trying to extend the window covering material must exert substantial force to the bottom rail 5 or window covering material 7 to extend the window covering material. Such force can cause damage to the window covering material, one or more of the pulleys, or the connector. Further, such binding can cause the window covering material 7 to be extended or retracted in an unbalanced manner such that there is a noticeable tilt of the bottom rail or window covering material during the extension or retraction of the window covering 1.

Figure 6:
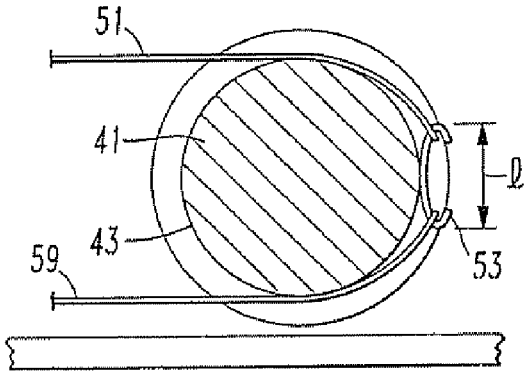
FIG. 6 is a side view of a first present preferred connector passing over a first present preferred pulley.

As may be appreciated from FIG. 6, I have found that such binding problems can be avoided with the use of a connector 53 that is attached to a spring motor cord 51 and lift cord 59 and has a length 1 that is not greater than ⅙, and preferably is not greater than 1/12 of the circumference of the one or more pulleys 41 the connector 53 is configured to pass over when the window covering material is moved from the retracted position to an extended position. It should be understood that the surface 43 of the pulley 41 that is configured to engage the connector when the connector passes along the pulley 41, defines the circumference of the pulley 41.

Figure 7:
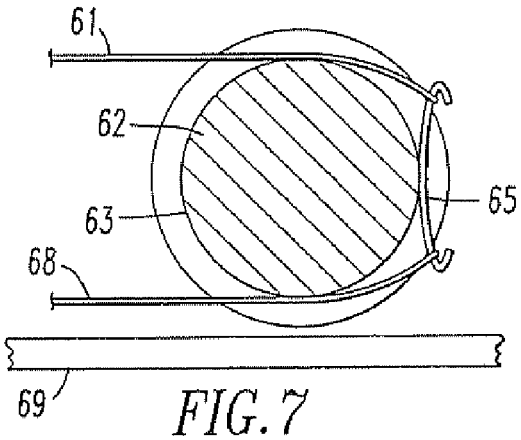
FIG. 7 is a side view of a connector that is problematic and should not be used in embodiments of my window covering because it is too long and does not permit the window covering material to be easily retracted and extended by a user.

In contrast, connectors 65 that are longer than ⅙ of the circumference range generally causes the binding problems discussed above. As may be appreciated from FIG. 7, such a connector 65, which is attached to a spring motor cord 61 and a lift cord 68, may engage the headrail 69 when it passes over the surface 63 of a pulley 62. Such contact may cause binding or otherwise increase the friction of the lift system so that a user must greatly increase the force applied to the bottom rail or window covering material to extend the window covering material. In some cases, the connector may be damaged when additional force is applied to the window covering material to overcome the binding problem.

A connector that has an undesirable length can also alter the balance of the window covering material or bottom rail as it is extended due to the forces being applied to the connector and the length of the connector and, consequently, create an undesirable aesthetic effect for the window covering. For instance, the window covering material or bottom rail may be lowered in an undesired non-level configuration. It is also possible that such a non-level configuration may correspond with a desired position of the window covering so that the window covering has an undesirable unbalanced appearance when lowered to that position by a user.

Figure 8:
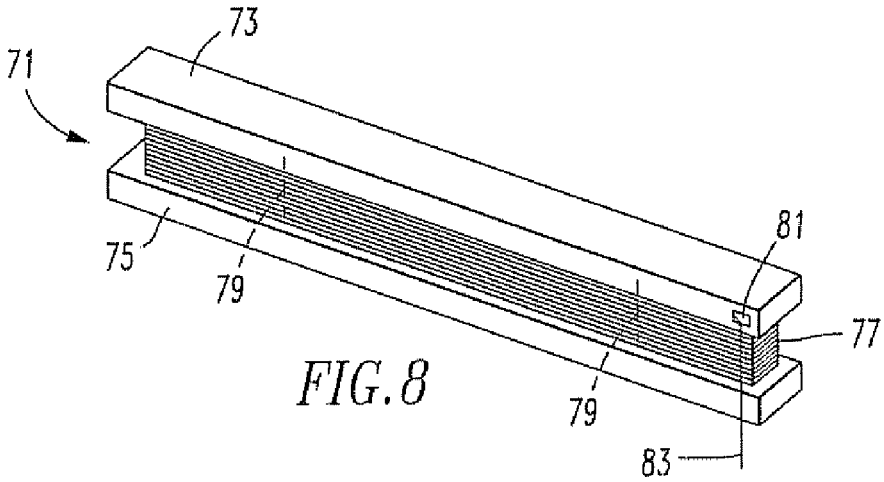
FIG. 8 is a perspective view of a second present preferred embodiment of my window covering illustrating the window covering material in a retracted position.

Referring to FIG. 8, a second present preferred embodiment of my window covering 71 includes a headrail 73, bottom rail 75 and window covering material 77 between the headrail 73 and bottom rail 75. Two ends of lift cord 79 are attached to the bottom rail 75, extend through the window covering material 77 and into the headrail 73. A cord lock 81 is located in the headrail. An operator cord 83 extends from the cord lock 81 so that a user may manipulate the operator cord to extend the window covering material 77 from the retracted position illustrated in FIG. 8 to a number of different extended positions.

Figure 9:
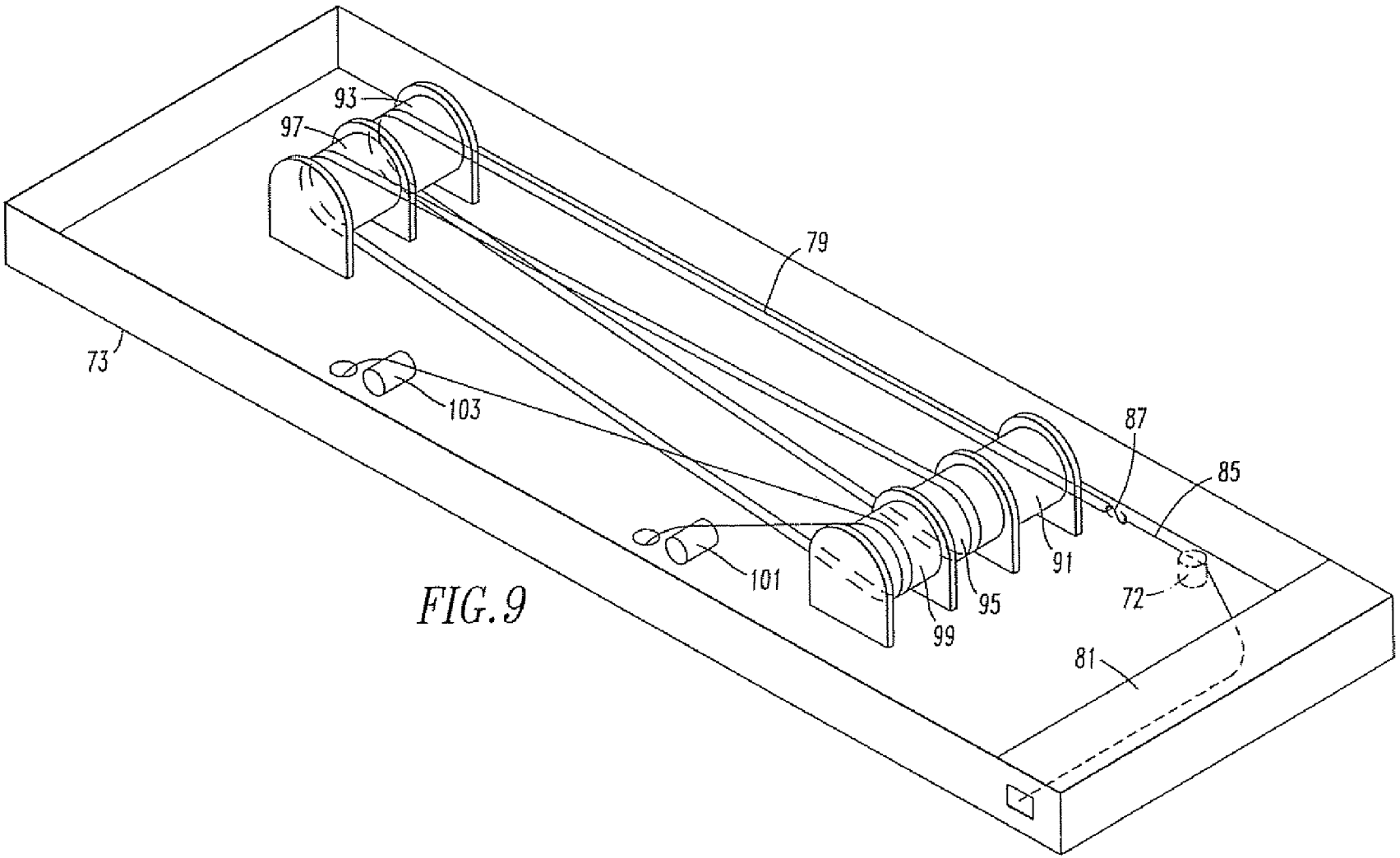
FIG. 9 is a perspective view of the second present preferred embodiment with a portion of the headrail cut way to illustrate the pulleys, cord lock, second present preferred connector and cord path wherein a portion of the cord path is shown in chain line.
Figure 10:
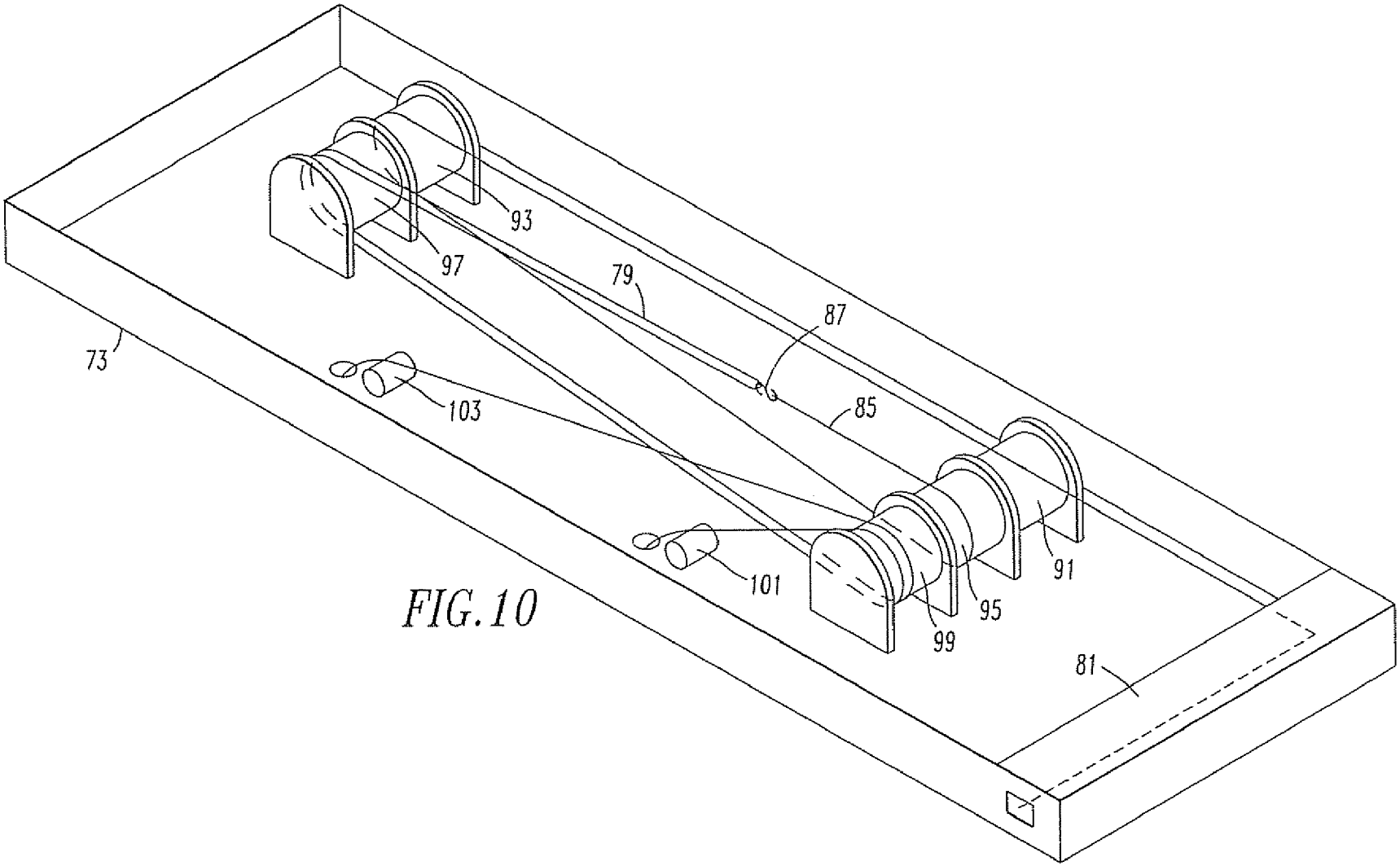
FIG. 10 is a perspective view similar to FIG. 9 illustrating the connector and first portion of the operator cord of the second present preferred embodiment in a position that corresponds with the window covering material being in an extended position.
Figure 11:
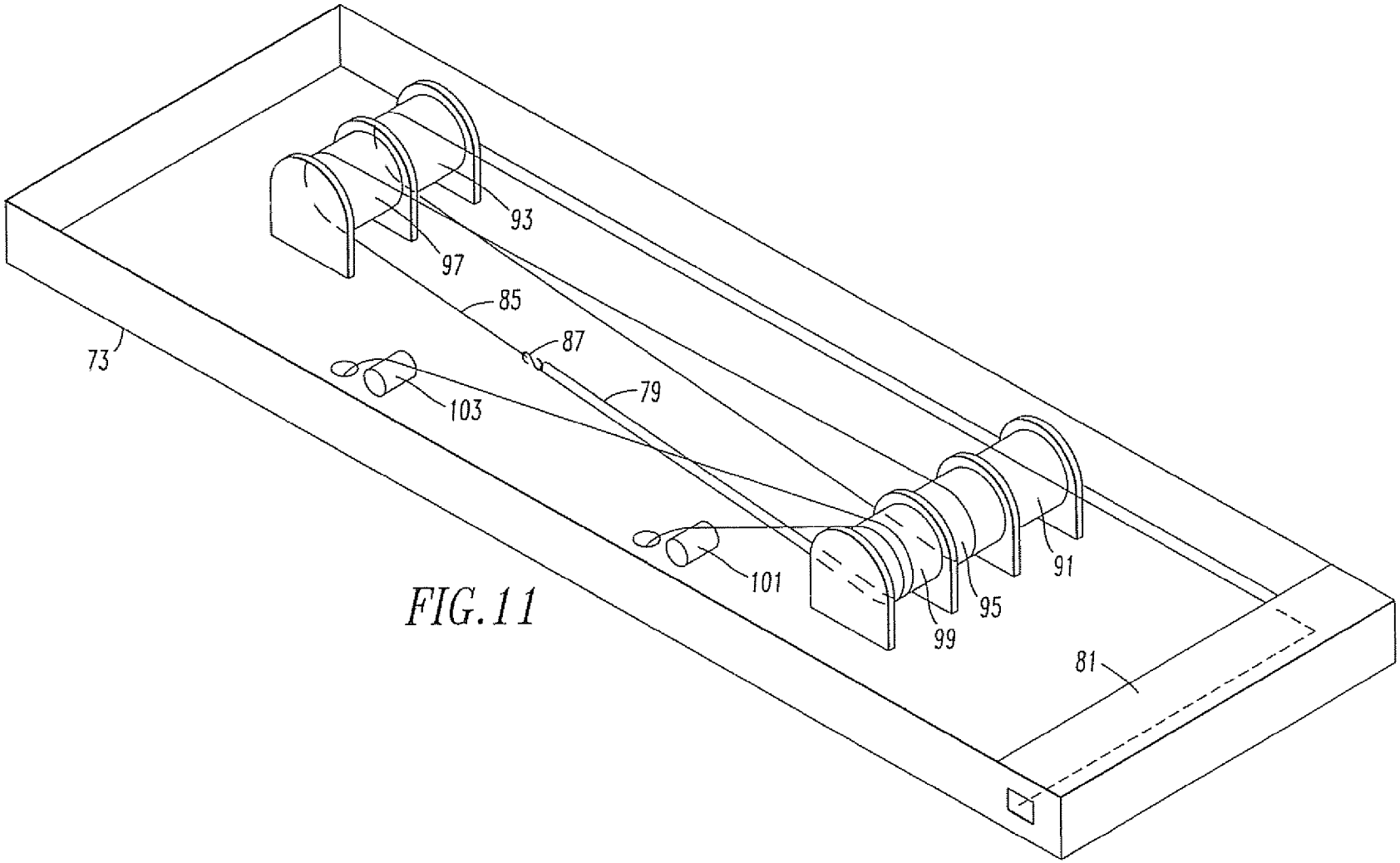
FIG. 11 is a perspective view similar to FIGS. 9 and 10 illustrating the connector and first portion of the operator cord of the second present preferred embodiment in a position that corresponds with the window covering material being in a fully extended position.

As may be seen in FIGS. 9-11, the operator cord 83 includes a first portion 85 that extends through the cord lock 81 and into the headrail 73 and is attached to a generally S-shaped connector 87. A middle portion of the lift cord 79 is attached to an opposite end of the connector 87 and extends over a first pulley 91, a second pulley 93, a third pulley 95, a fourth pulley 97 and a fifth pulley 99. Respective ends of the lift cord 79 also pass over respective pulleys 101 and 103 and then pass through respective holes in the headrail 73 and extend through the window covering material 77 to the bottom rail 75. The pulleys 91, 93, 95, 97 and 99 define a path the connector 87 and first portion of the operator cord 85 may travel along when the window covering material is moved from the retracted position to an extended position. One or more posts 72 may also be positioned adjacent the cord lock 81 to help define the path the connector 87 and first portion of the operator cord 85 may move along when the window covering material is extended from the retracted position. An example of such a post 72 is shown in dotted line in FIG. 9.

It should be appreciated that the length of the connector 87 should not be more than ⅙ of the circumference of one of the pulleys the connector 87 may pass over. As discussed above with reference to the generally C-shaped connector 13, such a length substantially avoids, if not completely eliminates, the "hang up" or binding problems associated with longer connectors.

When the window covering material 77 is extended to a first extended position shown in FIG. 10, the first portion of the operator cord 85 moves along the path and over the first pulley 91 toward the second pulley 93 and over the second pulley 93 toward the third pulley 95. It should be appreciated that the movement of the connector 87 and first portion 85 reverse directions when passing over the second pulley 93 to move toward the third pulley 95.

When the window covering material 77 is moved from the first extended position to a fully extended position, which is shown in FIG. 11, the connector 87 and first portion of the operator cord 85 move from the position located between the second pulley 93 and third pulley 95 over the third pulley 95 and toward and over the fourth pulley 97 until reaching a position between the fourth pulley 97 and fifth pulley 99.

Figure 12:
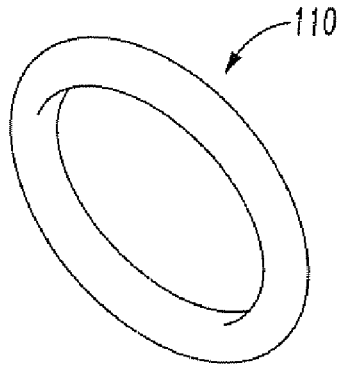
FIG. 12 is a perspective view of a third present preferred connector that may be utilized in embodiments of my window covering.
Figure 13:
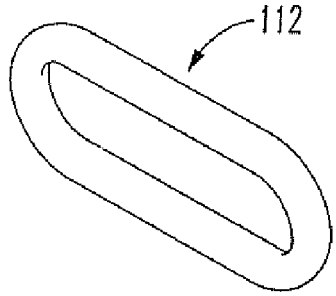
FIG. 13 is a perspective view of a fourth present preferred connector that may be utilized in embodiments of my window covering.

In addition to the generally C-shaped connector 13 and S-shaped connector 87 discussed above, other present preferred connectors may be used in embodiments of my window covering. For example, as illustrated in FIGS. 12 and 13, a generally circular ring shaped connector 110 or an elongated, generally oval shaped connector 112 may also be used. Preferably, one or more lift cords and one or more operator cords or spring motor cords are looped about respective ends of connector 110 or 112. Of course, these cords may also be tied to the respective ends of connector 110 or 112 or otherwise fastened to the connector 110 or 112.

It should be understood that the use of pulleys that reverse the direction of the connector and operator cord or spring motor cord discussed above permit the length of window covering material to be much longer than the length of headrail of the window covering while also avoiding binding problems associated with moving the connection between the spring motor cord or operator cord and the lift cord over such pulleys. Consequently, embodiments of my window coverings permit long window coverings to have short headrails.

The ability of the connector and spring motor cord or operator cord to pass over pulleys that reverse the direction of the connector and operator cord or spring motor cord also permits, embodiments of my window covering to be used in window coverings configured for a cut down program that may utilize only two or three standard sized window coverings that are then cut down by a blind cutting machine to fit various sized windows. Window coverings that do not permit a connection between the lift cord and operator cord or spring motor cord to pass over any pulleys are limited to a fully extended length that is often less than the length of the headrail and often cannot be economically used in such a program due to the limited window covering sizes such systems provide.

It should be appreciated that other variations of the present preferred embodiments discussed above may be made. For example, embodiments of my window covering can be top down bottom up shades. Embodiments of my window covering may also include shades or blinds that have one or more spring motors, pulleys, one or more lift cords and one or more spring motor cords located in or adjacent the bottom rail. As another example, embodiments of my window covering can include multiple lift cords that extend from the window covering material to the headrail rail and attach to one connector. As another example, each lift cord may be attached to a respective connector that is attached to one or more respective operator cords or spring motor cords. As yet another example, embodiments of my window covering can include pleated shades, cellular shades, venetian blinds, roman shades, and other shades or blinds. As yet an additional example, embodiments of my window covering may include one or more connectors or include connectors of various other shapes than those illustrated or discussed herein.

While certain present preferred embodiments of my window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail, the first rail having a first end and a second end opposite the first end;

window covering material adjacent the first rail, the window covering material moveable from a retracted position to an extended position;

at least one lift cord extending through the window covering material to the first rail;

a plurality of pulleys positioned adjacent the first rail, each pulley having a surface over which at least one cord passes that defines a circumference;

at least one spring motor adjacent the first rail, at least one spring motor cord extending from the at least one spring motor, the at least one spring motor cord configured to extend away from the at least one spring motor along a path defined by at least one of the plurality of pulleys when the window covering material is extended from the retracted position to the extended position and configured to be retracted toward the at least one spring motor along the path when the window covering material is retracted from the extended position to the retracted position; and a rigid connector attached to the at least one spring motor cord and the at least one lift cord, the connector being sized and configured to permit the at least one spring motor cord, connector and a portion of the at least one lift cord to pass along at least one of the plurality of pulleys during movement along the path, the connector having a length that is not greater than ⅙ of the circumference of at least one of the pulleys the connector passes over when the window covering material is extended from the retracted position to the extended position.

2. The window covering of claim 1 wherein the connector is comprised of one of a generally C-shaped body, a generally S-shaped body, a ring having a generally oval shaped body or a ring having a generally circular body.

3. The window covering of claim 1 further comprising a second rail connected to at least one of the first rail and the window covering material and wherein the first rail is a head-rail and the second rail is a bottom rail.

4. The window covering of claim 1 wherein the at least one lift cord is looped about the connector to attach the at least one lift cord to the connector.

5. The window covering of claim 1 wherein the at least one spring motor cord is looped about the connector to attach the at least one spring motor cord to the connector.

6. The window covering of claim 1 wherein the plurality of pulleys is comprised of a first pulley, a second pulley and a third pulley aligned with each other adjacent the first end of the first rail and a fourth pulley, fifth pulley and sixth pulley aligned with each other adjacent the second end of the first rail.

7. The window covering of claim 6 wherein the path is defined by movement of the at least one spring motor cord and the connector from adjacent the at least one spring motor to the first pulley, from the first pulley to the fourth pulley, from the fourth pulley to the second pulley and from the second pulley to the fifth pulley or the sixth pulley when the window covering material is extended from the retracted position to the extended position.

8. The window covering of claim 1 wherein the plurality of pulleys comprises three pulleys connected to a first pulley mount adjacent the first end of the first rail and three pulleys connected to a second pulley mount adjacent the second end of the first rail.

9. The window covering of claim 1 wherein the at least one spring motor cord, connector and a portion of the at least one lift cord pass along at least one of the plurality of pulleys during movement along the path such that movement of the at least one spring motor cord and connector is reversed from movement toward the first end of the first rail to movement toward the second end of the first rail at least once while moving along the path when the window covering material is retracted from the extended position to the retracted position or extended from the retracted potion to the extended position.

10. The window covering of claim 9 wherein the at least one spring motor cord, connector and a portion of the at least one lift cord pass along at least one of the plurality of pulleys during movement along the path such that movement of the at least one spring motor cord and connector is also reversed from movement toward the second end of the first rail to movement toward the first end of the first rail at least once while moving along the path when the window covering material is retracted from the extended position to the retracted position or extended from the retracted potion to the extended position.

11. A window covering comprising:

a first rail, the first rail having a first end and a second end opposite the first end;

window covering material adjacent the first rail, the window covering material moveable from a retracted position to an extended position;

at least one lift cord extending through the window covering material to the first rail;

a plurality of pulleys positioned adjacent the first rail, each pulley having a surface over which at least one cord passes that defines a circumference;

a cord lock adjacent the first rail, at least one operator cord extending from the cord lock, the at least operator cord comprising a first portion configured to extend from the cord lock along a path defined by at least one of the plurality of pulleys when the window covering material is extended from the retracted position to the extended position and configured to be retracted toward the cord lock along the path when the window covering material is retracted from the extended position to the retracted position; and a rigid connector attached to the first portion of the at least one operator cord and the at least one lift cord, the connector being sized and configured to permit the first portion of the at least one operator cord, connector and a portion of the at least one lift cord to pass along at least one of the plurality of pulleys during movement along the path, the connector having a length that is not greater than ⅙ of the circumference of at least one of the pulleys the connector passes over when the window covering material is extended from the retracted position to the extended position.

12. The window covering of claim 11 wherein the connector is comprised of one of a generally C-shaped body, a generally S-shaped body, a ring having a generally oval shaped body or a ring having a generally circular body.

13. The window covering of claim 11 wherein the plurality of pulleys comprises three pulleys connected to a first pulley mount adjacent the first end of the first rail and three pulleys connected to a second pulley mount adjacent the second end of the first rail.

14. The window covering of claim 11 further comprising a second rail connected to at least one of the first rail and the window covering material and wherein the first rail is a head-rail and the second rail is a bottom rail.

15. The window covering of claim 11 wherein the at least one lift cord is looped about the connector to attach the at least one lift cord to the connector.

16. The window covering of claim 11 wherein the first portion of the at least one operator cord is looped about the connector to attach the first portion of the at least one operator cord to the connector.

17. The window covering of claim 1 wherein the plurality of pulleys is comprised of a first pulley, a second pulley and a third pulley aligned with each other adjacent the first end of the first rail and a fourth pulley, fifth pulley and sixth pulley aligned with each other adjacent the second end of the first rail.

18. The window covering of claim 17 wherein the path is defined by movement of the first portion of the at least one operator cord and the connector to move from adjacent the cord lock to the first pulley, from the first pulley to the fourth pulley, from the fourth pulley to the second pulley and from the second pulley to the fifth pulley or the sixth pulley when the window covering material is extended from the retracted position to the extended position.

19. The window covering of claim 11 wherein the first portion of the at least one operator cord, connector and a portion of the at least one lift cord pass along at least one of the plurality of pulleys during movement along the path such that movement of the first portion of the at least one operator cord and connector is reversed from movement toward the first end of the first rail to movement toward the second end of the first rail while moving along the path when the window covering material is retracted from the extended position to the retracted position or extended from the retracted potion to the extended position.

20. The window covering of claim 19 wherein the at least one operator cord, connector and a portion of the at least one lift cord pass along at least one of the plurality of pulleys during movement along the path such that movement of the at least one operator cord and connector is also reversed from movement toward the second end of the first rail to movement toward the first end of the first rail at least once while moving along the path when the window covering material is retracted from the extended position to the retracted position or extended from the retracted potion to the extended position.

* * * * *